US005320346A

United States Patent [19]

Phillips

[11] Patent Number: 5,320,346

[45] Date of Patent: Jun. 14, 1994

[54] GOLF PUTTER WITH ADJUSTABLE SHAFT

[76] Inventor: James W. Phillips, 3087 Landmark Blvd., #1804, Palm Harbor, Fla. 34684

[21] Appl. No.: 74,129

[22] Filed: Jun. 8, 1993

[51] Int. Cl.[5] ..... A63B 53/02

[52] U.S. Cl. ..... 273/79; 273/80.1; 273/80 C; 273/171; 273/167 G

[58] Field of Search ..... 273/80.1–80.9, 273/79, 77 R, 167 F, 169, 171, 167 H, 173, 164.1; 403/76, 90, 362

[56] References Cited

U.S. PATENT DOCUMENTS

| | | | |
|---|---|---|---|
| 749,174 | 1/1904 | Davis | 273/79 |
| 1,352,020 | 9/1920 | Olson | 273/79 |
| 1,643,250 | 9/1927 | Longsworth | 273/79 |
| 2,708,579 | 5/1955 | Hugman | 273/80.1 X |
| 3,096,982 | 7/1963 | Bassin | 273/80.1 |
| 3,214,170 | 10/1965 | Warnock | 273/80.1 |
| 3,397,888 | 8/1968 | Springer et al. | 273/80.1 |
| 3,423,089 | 1/1969 | Andis | 273/80.1 |
| 3,448,981 | 6/1969 | Anweiler | 273/167 GX |
| 3,979,123 | 8/1976 | Belmont | 273/171 |
| 4,073,492 | 2/1978 | Taylor | 273/80.2 |
| 4,111,426 | 9/1978 | Goodwin | 273/80.1 X |
| 4,227,694 | 10/1980 | Drake | 273/80 C X |
| 4,569,523 | 2/1986 | Jarvis | 273/164 |
| 4,607,846 | 8/1986 | Perkins | 273/171 |
| 4,621,816 | 11/1986 | Leek | 273/80 C X |
| 4,714,252 | 12/1987 | Rorabeck | 273/171 |
| 4,754,977 | 7/1988 | Sahm | 273/171 |
| 4,815,740 | 3/1989 | Williams | 273/80.1 |
| 4,852,879 | 8/1989 | Collins | 273/164.1 |
| 4,869,507 | 9/1989 | Sahm | 273/171 |
| 4,881,737 | 11/1989 | Mullins | 273/80.1 X |
| 5,050,879 | 9/1991 | Sun et al. | 273/80 |
| 5,116,047 | 5/1992 | Phelan et al. | 273/80.1 |
| 5,121,922 | 6/1992 | Harsh, Sr. | 273/164 |
| 5,226,654 | 7/1993 | Solheim | 273/80 C X |
| 5,244,205 | 9/1993 | Melanson | 273/80.1 X |

*Primary Examiner*—Vincent Millin
*Assistant Examiner*—Sebastiano Passaniti
*Attorney, Agent, or Firm*—Herbert W. Larson

[57] ABSTRACT

A golf shaft is attached to a removable sphere at a first end portion below an offset in the shaft. The sphere is mounted within a pocket of a top portion of a putter head and seats within a first cavity in a bottom portion of the putter head when the top and bottom portions of the putter head are joined. Set screws located in the bottom portion of the putter head retain the sphere and a half sphere located in a second cavity in the bottom portion seated in place. Retraction of the set screws to the sphere permits movement of the shaft so that its angle with respect to the putter head can be adjusted.

8 Claims, 3 Drawing Sheets

GOLF PUTTER WITH ADJUSTABLE SHAFT

BACKGROUND OF THE INVENTION

1. Field of the Invention

This invention relates to a golf putter. More particularly, it relates to a golf putter with an adjustable shaft to adjust the angle of the shaft with respect to the putter head and a variable weight distributing putter head.

2. Description of Prior Art

The principal of adding weights to putter heads and providing a means to transfer the shaft connection in the putter head to accommodate either a right handed or left handed golfer is well known as seen from U.S. Pat. Nos. 3,397,888, 5,116,047 and 5,121,922.

In U.S. Pat. No. 3,397,888, a golf club has a shaft which can be inserted into a hole selected from a linear row of holes on two separate surfaces of the club head. This permits the use of the club by either a right or left handed golfer and provides for selection from two different golf faces for use in striking a golf ball.

In U.S. Pat. No. 5,116,047, the putter head has three threaded holes so that an end of the golf shaft can be locked in place in any one of the holes to permit use of the putter for either a right handed or left handed golfer. In addition, two weights can be added to the putter head.

In U.S. Pat. No. 5,121,922, there is a rearwardly extending head portion containing weights to alter the center of gravity of the putter head.

While the prior art patents are useful for their intended purpose, golfers are continuously on the look out for improved putters which will enhance their putting skills. Such an improved putter is the subject of the present invention.

SUMMARY OF THE INVENTION

I have invented a putter which can be used by either a right or left handed golfer, can be easily adjusted to vary the angle between the golf shaft and head and contains the proper weight balancing element to provide a smooth putting stroke.

My adjustable golf putter has an offset in its shaft proximal to the putter head. A removable sphere is attached at the end of the shaft and is mountable within a pocket located in the putter head. Set screws retain the sphere in place. By simply retracting the screws, the sphere is moved to change the angle of the shaft with respect to the putter head. A half sphere is placed in a cavity in the putter head distal from the shaft to balance the weight of the sphere attached to the shaft.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
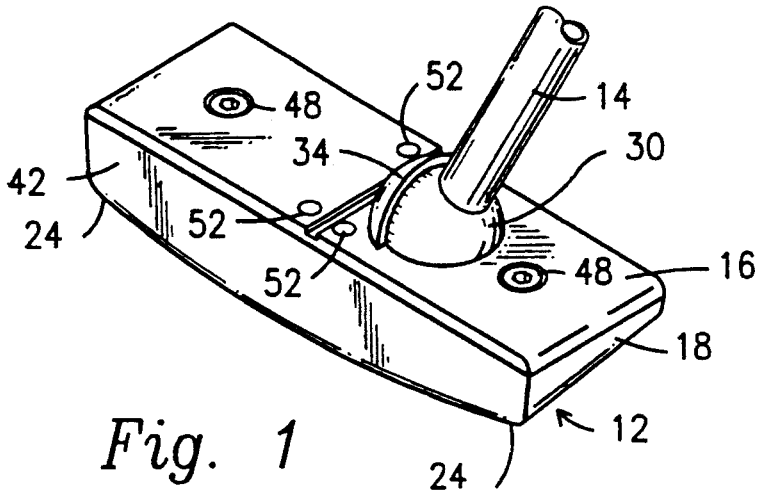
FIG. 1 is a perspective view of the putter head and shaft end engaging the putter head.

Throughout the following detailed description, the same reference numerals refer to the same elements in all figures.

Figure 2:
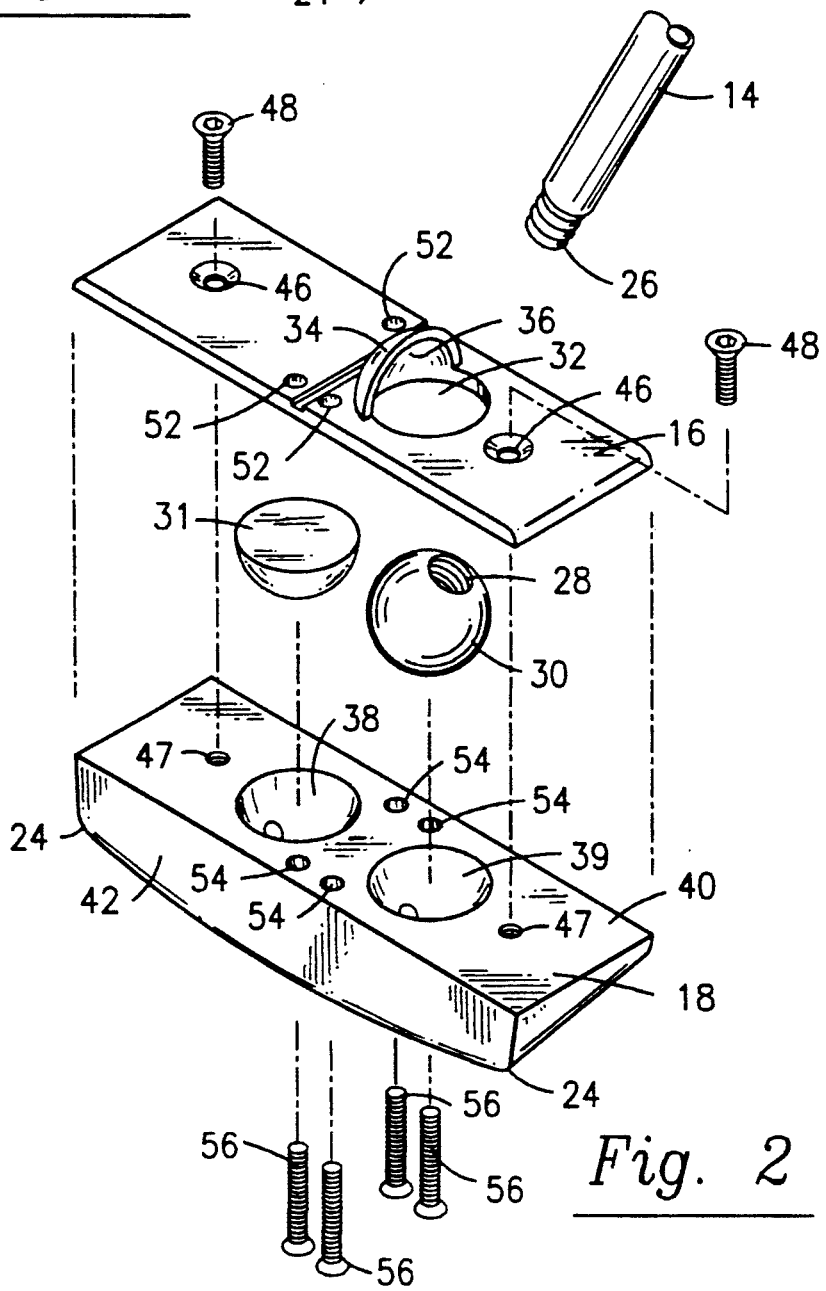
FIG. 2 is an exploded perspective view of the putter and shaft end.
Figure 5:
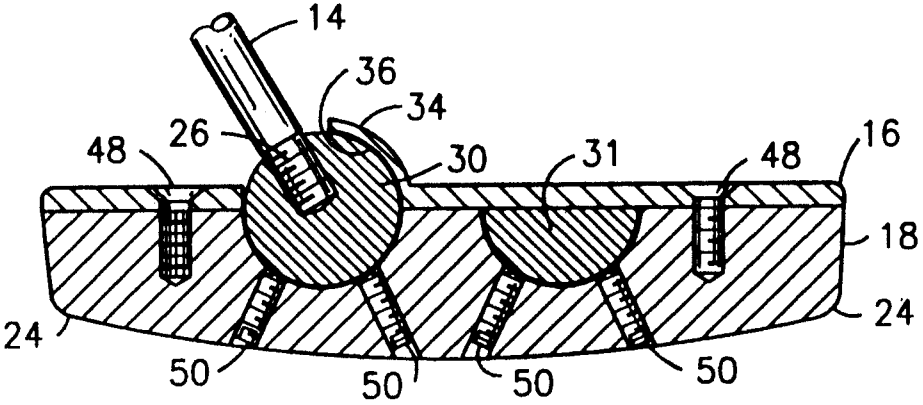
FIG. 5 is a side view in section of the putter head with the handle set for a left handed configuration.
Figure 6:
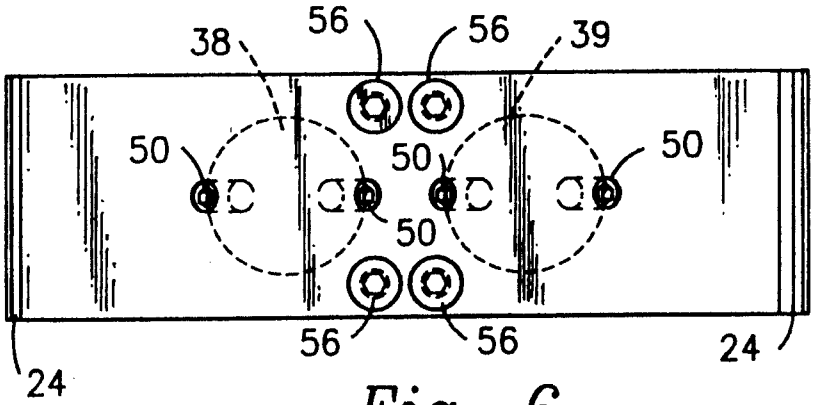
FIG. 6 is a bottom plan view of the bottom portion of the putter head.
Figure 3:
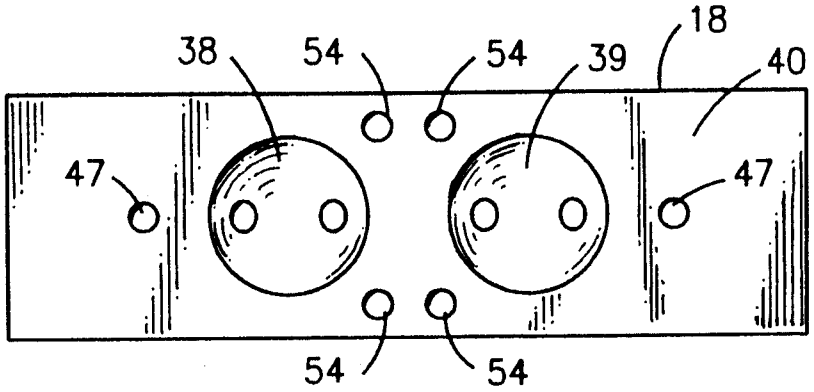
FIG. 3 is a top plan view of the bottom portion of the putter head.
Figure 4:
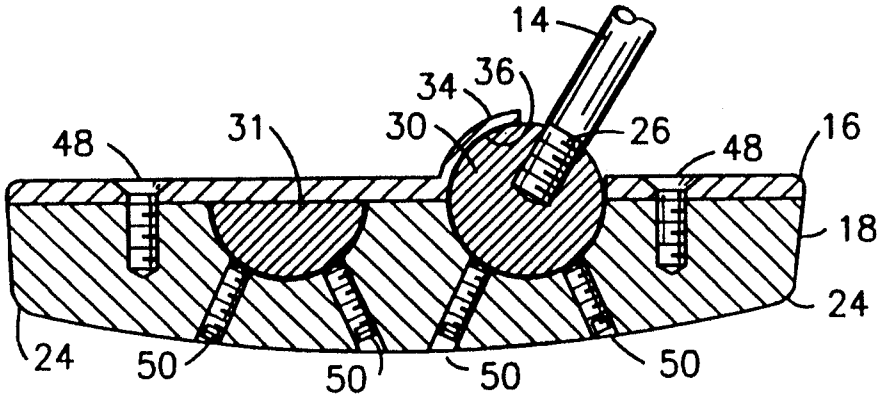
FIG. 4 is a side view in section of the putter head with the handle set for a right handed configuration.
Figure 7:
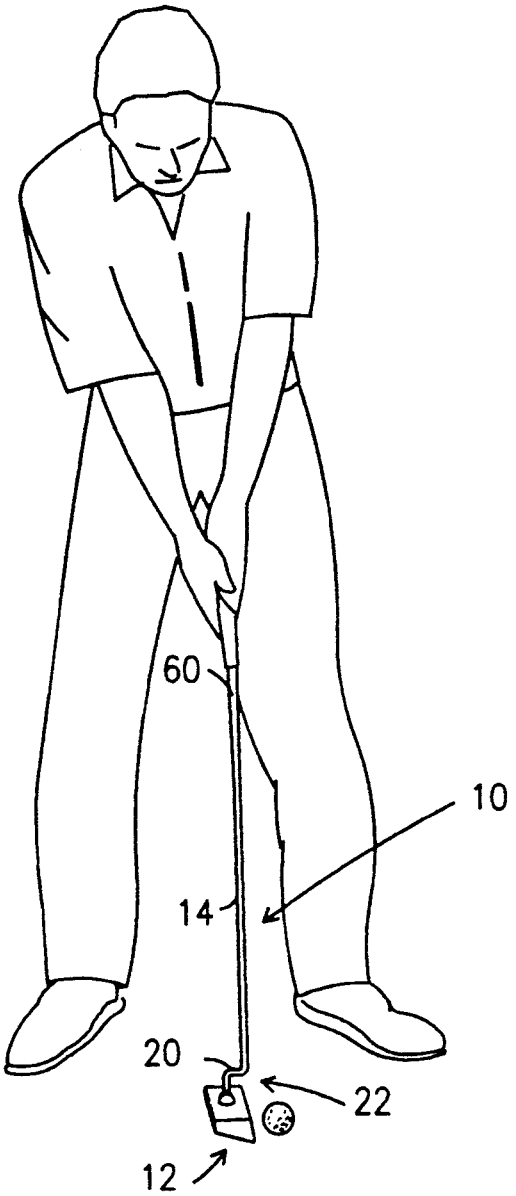
FIG. 7 is a perspective view of a right handed golfer using the adjustable golf putter.
Figure 8:
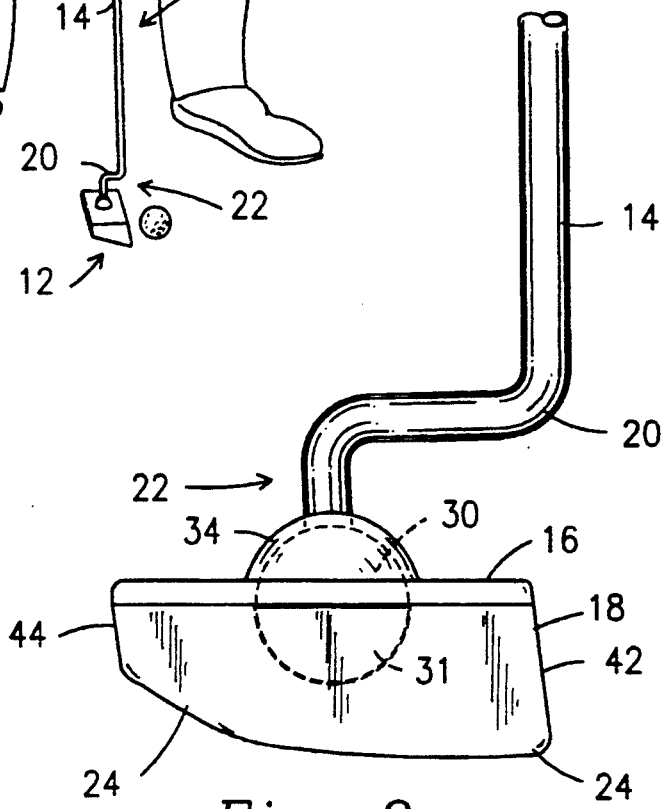
FIG. 8 is a front end view of the putter head showing the sphere in phantom.

A golf putter 10, as shown in FIG. 7, has a putter head 12 and shaft 14 as shown in FIG. 1. The putter head 12 has a top portion 16 and a bottom portion 18, as shown in FIG. 2. The shaft 14 has an offset 20, as shown in FIG. 8, at a first end portion 22 of the shaft 14 proximal to putter head 12. The offset 20 of the shaft 14 has two right angled turns at a bottom portion so that the first end portion 22 of the shaft 14 is parallel to the longitudinal direction of an upper portion of the shaft, the upper portion of the shaft 14 mounted above a striking face 42. A threaded shank 26 axially extends from the first end portion 22 of the shaft 14 and engages with a threaded bore 28 of a removable sphere 30, as shown in FIGS. 4 and 5.

The top portion 16 of putter head 12 has an aperture 32 with an arcuate partial housing 34 extending over aperture 32 forming a pocket 36, as shown in FIG. 2. The pocket 36 prohibits the removable sphere 30 from disengaging from the top portion 16 of the putter head 12, as shown in FIG. 1.

The bottom portion 18 of the putter head 12 has a pair of cavities 38 and 39 respectively on a top surface 40, as shown in FIG. 2. The removable sphere 30 rests in one of the cavities 38 or 39 depending on the dominant hand of a golfer and the relative position of a striker face 42 in the putter head 12. The striker face 42 is identified as the plate with the larger surface area compared to a back plate 44. Both the striker face 42 and back plate 44 have curved edges 24 at their respective ends.

For a right handed golfer, the removable sphere 30 rests in cavity 39 proximal to the golfer when the striker face 42 is to the left of the cavity 39. For a left handed golfer, the removable sphere 30 rests in cavity 38 proximal to the golfer when the striker face 42 is to the right of the cavity 38. The positioning of sphere 30 in cavity 38 or 39 and the resulting angle of shaft 14 extending from putter head 12 is determined by the golfer on an individual basis and is determined by preferred angle of shaft 14. The remaining cavity 38 or 39 is filled with a removable half sphere 31, as shown in FIG. 2, which acts as a counter balance distributing weight through the putter head 12, thereby bringing the center of gravity to the middle of putter head 12.

The top portion 16 and bottom portion 18 respectively of the putter head 12 have a plurality of axially aligned large tapped bores 46 and 47 for receiving screws 48 locking top portion 16 and bottom portion 18 together forming putter head 12, as shown in FIG. 2. Smaller tapped bores 52 axially align with bores 54 in bottom portion 18 and screws 56 screwed in from the bottom of bottom portion 18 also assist in attaching top portion 16 to bottom portion 18. Multiple set screws 50 in bottom portion 18 hold sphere 30 and half sphere 31 in place, as shown in FIGS. 4 and 5.

A second end 60 of the shaft 14 has a rubberized grip 62 attached. The shaft 14 can be made of aluminum, steel or graphite. The head 12 is made of steel as are sphere 30 and half sphere 31.

Equivalent elements can be substituted for the ones set forth above to achieve the same results in the same manner.

Having thus described the invention what is claimed and desired to be secured by Letters Patent is:

1. A golf putter with a shaft attached to a weighted putter head comprising, the shaft having an offset with respect to the longitudinal direction of the shaft at a first end portion proximal to the putter head, the putter head having a top and bottom portion with the bottom portion containing first and second cavities in a top surface, a pocket formed in the putter head top portion, a removable sphere attached to the first end portion of the shaft below the offset for insertion within the pocket of the putter head top portion and seated within the first cavity in the putter head bottom portion when the top and bottom portions are joined, a plurality of bores in the putter head top and bottom portions axially aligned for receipt of screws to join the top and bottom portions together, and a removable half sphere inserted within the second cavity so that a balance of weight distribution is achieved in the putter head.

2. A golf putter according to claim 1 wherein set screws mounted within a bottom surface of the bottom portion of the putter head fixedly seat the sphere and half sphere in place within the first and second cavity respectively.

3. A golf putter according to claim 1 wherein threads at the first end portion of the shaft engage threads within the removable sphere to attach the shaft to the sphere.

4. A golf putter according to claim 1 wherein the offset consists of two right angled turns in the shaft so that the first end portion of the shaft below the offset is parallel to the direction of the shaft above the offset.

5. A golf putter according to claim 1 wherein the pocket of the putter head top portion is formed by an arcuate raised surface of the top portion, together with an aperture in the top portion having a diameter smaller than the diameter of the sphere.

6. A golf putter having a shaft attached to a putter head comprising, the shaft having two right angled turns at a bottom portion so that an end portion of the shaft is parallel to the longitudinal direction of an upper portion of the shaft, the end portion of the shaft attached to a sphere movably mounted between a top and bottom portion of the putter head and held in place within both a pocket in the top portion and a first cavity in the bottom portion by set screws, when the top and bottom portions are joined together, a half sphere mounted within a second cavity in the bottom portion and the sphere and half sphere being reversibly mountable in their respective cavities to permit the golf putter to be used by either a right handed or left handed golfer.

7. The golf putter according to claim 6 wherein the upper portion of the shaft is mounted above a striking face of the putter.

8. The golf putter according to claim 6 wherein the shaft and sphere are attached by mutually engageable threads.

* * * * *